US006329130B1

(12) United States Patent
Lussier et al.

(10) Patent No.: US 6,329,130 B1
(45) Date of Patent: Dec. 11, 2001

(54) SILVER HALIDE PHOTOGRAPHIC ELEMENT, IMAGING PROCESS, AND COMPOUND

(75) Inventors: Barbara B. Lussier, Rochester; Michael J. Proseus, Webster; Paul A. Burns, Rochester; Brian Thomas, Pittsford; Frank D. Coms, Fairport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/747,695

(22) Filed: Dec. 22, 2000

(51) Int. Cl.[7] ..... G03C 1/08; G03C 7/26; G03C 7/32

(52) U.S. Cl. ..... 430/557; 430/556; 430/543

(58) Field of Search ..... 430/556, 557, 430/543

(56) References Cited

U.S. PATENT DOCUMENTS

| | | | | |
|---|---|---|---|---|
| 5,362,617 | * | 11/1994 | Morigaki et al. | 430/557 |
| 5,677,114 | | 10/1997 | Lussier et al. . | |
| 5,834,167 | * | 11/1998 | Lussier et al. | 430/557 |
| 6,040,126 | * | 3/2000 | Tang et al. | 430/557 |
| 6,071,683 | | 6/2000 | Goddard et al. . | |
| 6,077,658 | * | 6/2000 | Lussier et al. | 430/557 |

FOREIGN PATENT DOCUMENTS

| | | | |
|---|---|---|---|
| 55-93153 | * | 7/1980 | (JP) . |
| 1-180547 | | 7/1989 | (JP) . |
| 11-352647 | * | 12/1999 | (JP) . |

OTHER PUBLICATIONS

JP Abstract 1–180547.

* cited by examiner

*Primary Examiner*—Geraldine Letscher

(74) *Attorney, Agent, or Firm*—Arthur E. Kluegel

(57) ABSTRACT

Disclosed is a photographic element comprising a light sensitive silver halide emulsion layer having associated therewith a yellow dye-forming coupler having formula I:

I wherein each A is independently a divalent group selected from the divalent groups consisting of aryl and —C($R^1$)($R^2$)—, in which each $R^1$ and $R^2$ is independently selected from the group consisting of hydrogen, alkyl, alkoxy, aryloxy, heterocyclic, and aryl groups, and one A can be joined to form a ring with another A or with $R^3$, and m is from 2 to 6;

$R^3$ is selected from the group consisting of hydrogen, alkyl, heterocyclic, and aryl groups, provided that $R^3$ may form a ring with A or is a group joined to $R^4$ to form a heterocyclic five- or six-membered ring;

$R^4$ is selected from the group consisting of aryl, heterocyclic, and alkyl groups and may form a heterocyclic ring bonded to $R^3$;

Y is selected from the group consisting of —$SO_2$—, —C(=O)—, —C(=O)$NR^9R^{10}$—, —C(=O)O—, and —P(=O)($OR^9$)($OR^{10}$—) where $R^9$ and $R^{10}$ are independently H or an alkyl or aryl group; and the remaining substituents are as described in the summary of the invention.

23 Claims, No Drawings

SILVER HALIDE PHOTOGRAPHIC ELEMENT, IMAGING PROCESS, AND COMPOUND

FIELD OF THE INVENTION

This invention relates to a silver halide photographic element containing an acylacetanilide yellow dye-forming coupler having an anilide ring bearing an ortho oxy group and a certain para ester group.

BACKGROUND OF THE INVENTION

Color silver halide photographic elements are well-known in the art. They typically include one or more light-sensitive silver halide emulsion layers sensitive to blue light that contain a yellow dye-forming coupler capable of producing a yellow image dye upon development. Most common among the suitable yellow dye-forming couplers are those based on acylacetanilide compounds. Typically the compounds are pivaloyl acetanilides.

U.S. Pat. No. 5,667,114 of Lussier et al., discloses a certain pivaloyl acetanilide coupler that contains a particular phenoxy group in the anilide ballast and provides desirable dye stability. U.S. Pat. No. 6,071,683 of Goddard et al., discloses a certain pivaloyl acetanilide coupler that contains a particular oxy group on the anilide ring of the ballast and provides desirable dye light stability.

While such compounds have been useful for providing yellow dye of the desirable density and hue needed for color imaging, further improvements in the photographic properties are needed.

It is a problem to be solved to provide a photographic element that provides a yellow dye-forming coupler that has an improved combination of reactivity and dye stability.

SUMMARY OF THE INVENTION

The invention provides a photographic element comprising a light sensitive silver halide emulsion layer having associated therewith a yellow dye-forming coupler having formula I:

I

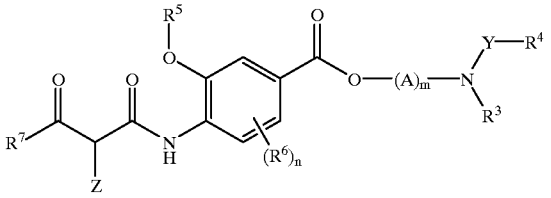

wherein each A is independently a divalent group selected from the divalent groups consisting of aryl and —C($R^1$)($R^2$)—, in which each $R^1$ and $R^2$ is independently selected from the group consisting of hydrogen, alkyl, alkoxy, aryloxy, heterocyclic, and aryl groups, and one A can be joined to form a ring with another A or with $R^3$, and m is from 2 to 6;

$R^3$ is selected from the group consisting of hydrogen, alkyl, heterocyclic, and aryl groups, provided that $R^3$ may form a ring with A or is a group joined to $R^4$ to form a heterocyclic five- or six-membered ring;

$R^4$ is selected from the group consisting of aryl, heterocyclic, and alkyl groups and may form a heterocyclic ring bonded to $R^3$;

$R^5$ is an aryl or alkyl group;

each $R^6$ is an independently selected substituent and n is 0 to 3, provided that two $R^6$ groups may join to from a ring;

$R^7$ is selected from a group consisting of alkyl, aryl, heterocyclic, alkoxy, and amino groups;

Y is selected from the group consisting of —$SO_2$—, —C(=O)—, —C(=O)$NR^9R^{10}$—, —C(=O)O—, and —P(=O)($OR^9$)($OR^{10}$—) where $R^9$ and $R^{10}$ are independently H or an alkyl or aryl group; and Z is hydrogen or a coupling-off group.

The invention also provides a coupler compound and a method of forming an image in the photographic element of the invention.

Photographic elements of the invention provide an improved combination of speed, reactivity, and dye stability.

DETAILED DESCRIPTION OF THE INVENTION

The invention is generally as described above. In formula I, each A is independently a divalent group selected from the group consisting of aryl, and —C($R^1$)($R^2$)—, in which each $R^1$ and $R^2$ is independently selected from the group consisting of hydrogen, alkyl, alkoxy, aryloxy, heterocyclic, and aryl groups, and one A can be joined to form a ring with another A or with $R^3$, and m is from 2 to 6. Desirably, the divalent group has the formula —C($R^1$)($R^2$)—. Particularly useful are such groups where m is 2. Among the groups desirable as $R^1$ or $R^2$ are hydrogen, alkyl, alkoxy methylene and aryloxy methylene groups.

In formula I, $R^3$ is selected from the group consisting of hydrogen, alkyl, heterocyclic, and aryl groups, provided that $R^3$ may form a ring with A or is a group joined to $R^4$ to form a heterocyclic five- or six-membered ring. $R^4$ is selected from the group consisting of aryl, heterocyclic, and alkyl groups and may form a heterocyclic ring bonded to $R^3$. Usually, $R^3$ and $R^4$ contain the necessary carbon atoms to ballast the compound in an organic solvent.

When an $R^1$ or $R^2$ substituent represents a phenoxy containing group, it is desirable that $R^4$ is an alkyl group of 1–3 carbon atoms. Additionally, selection of substituents providing the desired ballasting but having lower molecular weights is preferred from a cost and materials efficiency standpoint.

In formula I, $R^5$ is an aryl or alkyl group. Most suitably, it is a lower alkyl group of 1–4 carbons. Particularly useful are methyl, ethyl, and isopropyl groups. Each $R^6$ is a substituent group provided that two $R^6$ groups may join to from a ring. Suitably, the group is independently selected from the group consisting of halogen, amino, and alkyl groups, and groups connected to the ring by oxygen or sulfur. "n" is 0 to 3.

$R^7$ is selected from a group consisting of alkyl, aryl, heterocyclic, alkoxy, and amino groups. Conveniently used are phenyl, t-butyl, methylcyclopropyl, arylamines and nitrogen heterocycles.

In formula I, Y is selected from the group consisting of —$SO_2$—, —C(=O)—, —C(=O)$NR^9R^{10}$—, —C(=O)O—, and —P(=O)($OR^9$)($OR^{10}$—) where $R^9$ and $R^{10}$ are independently an alkyl or an aryl group. The groups —$SO_2$—, —C(=O)— are most readily employed. Z is hydrogen, or a group capable of coupling-off when the coupler reacts with an oxidized color-developing agent. Z is suitably hydrogen or a five- or six-membered heterocyclic ring group wherein the group Z is bonded to the remainder of the coupler through a nitrogen atom in the ring. Examples include five and six membered containing one or more ring nitrogen atoms including azoles such as pyrazoles, succinimides, and hydantoin compounds. It is possible for Z to contain a timing group (e.g. phenoxy quinone methide) or other linking group (e.g. acyloxy) designed to release a Photographically Useful Group (PUG). Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo.

The following are specific examples of couplers useful in the invention.

Y-1

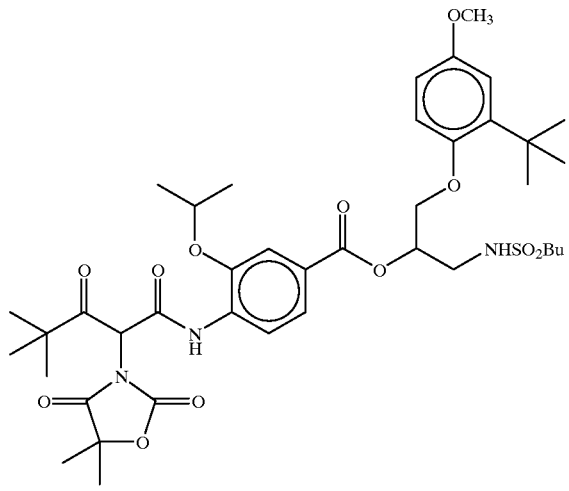

Y-2

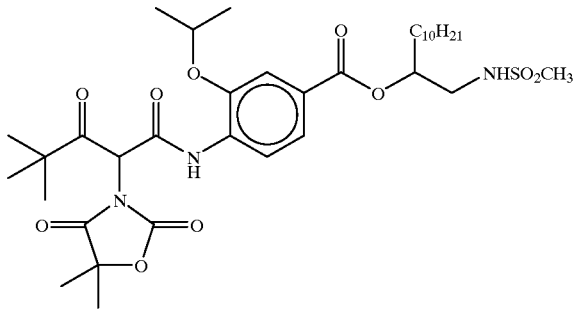

Y-3

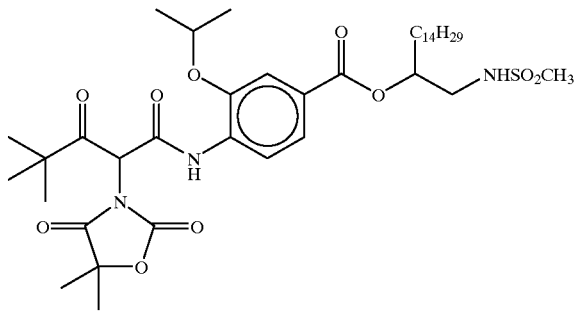

-continued
Y-4
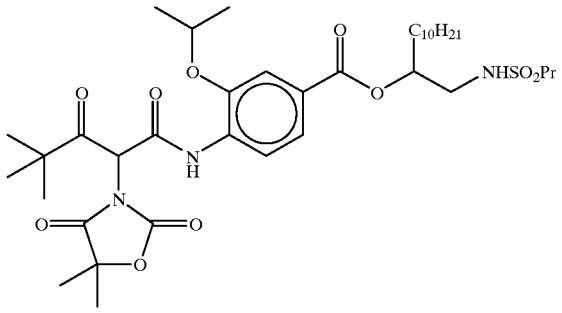
Y-5
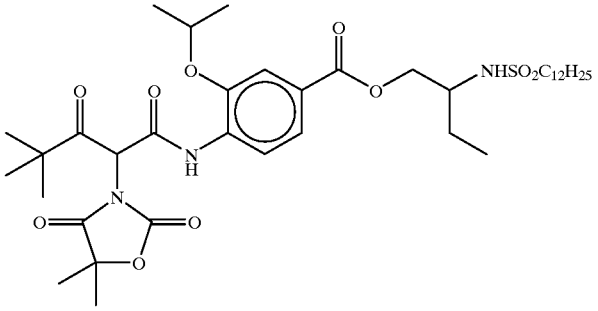
Y-6
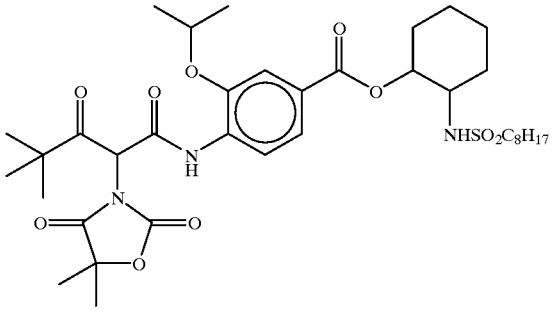
Y-7
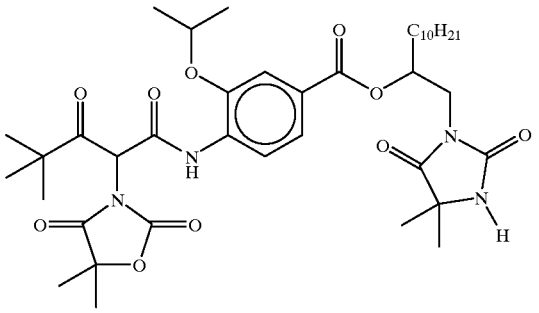

-continued
Y-8
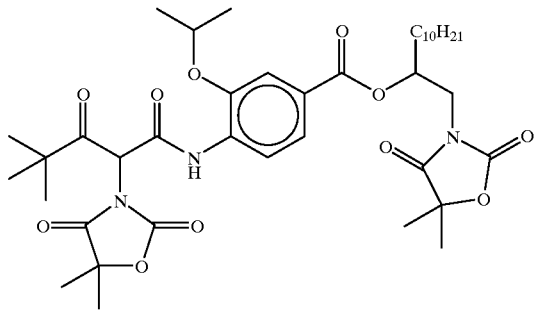
Y-9
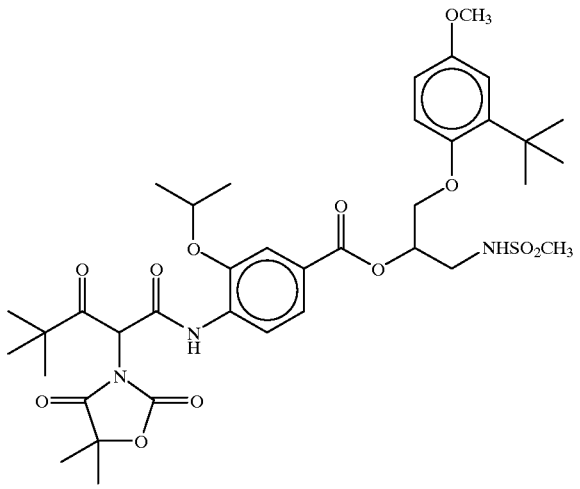
Y-10
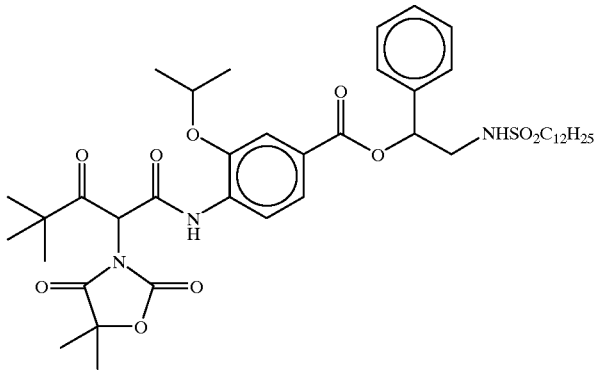
Y-11
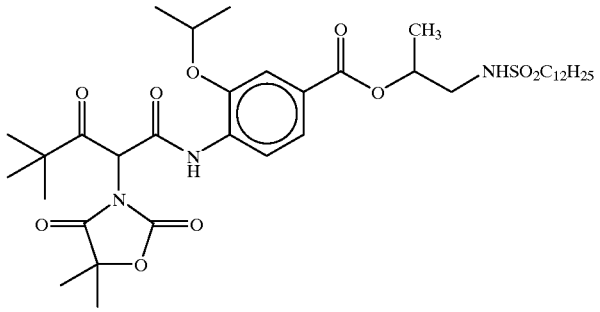

-continued
Y-12
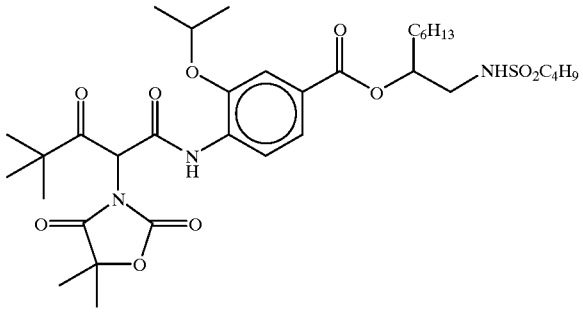
Y-13
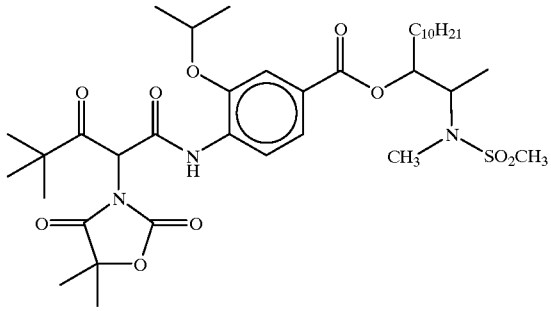
Y-14
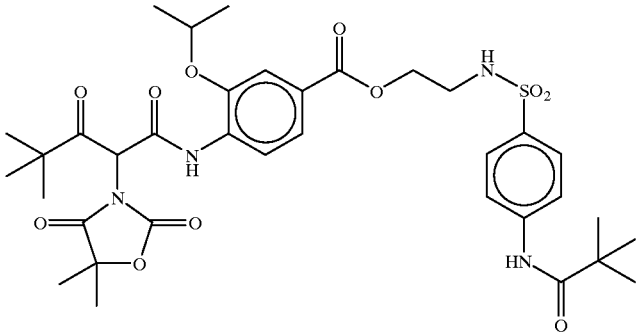
Y-15
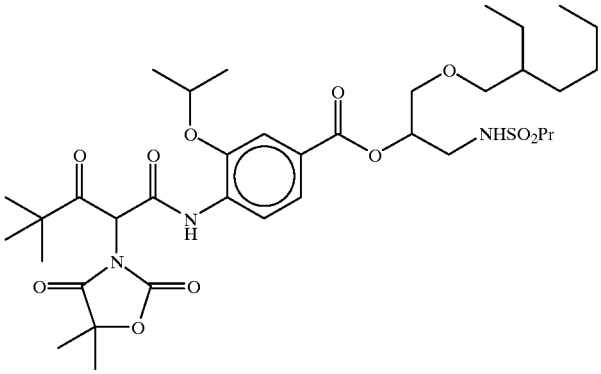

-continued
Y-16
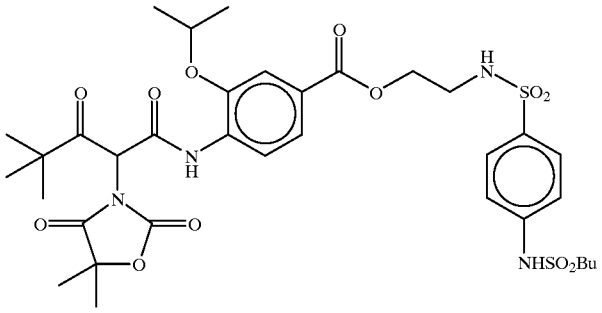
Y-17
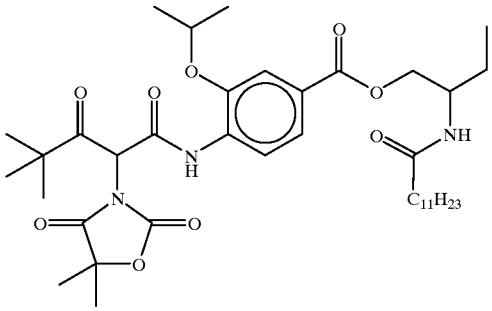
Y-18
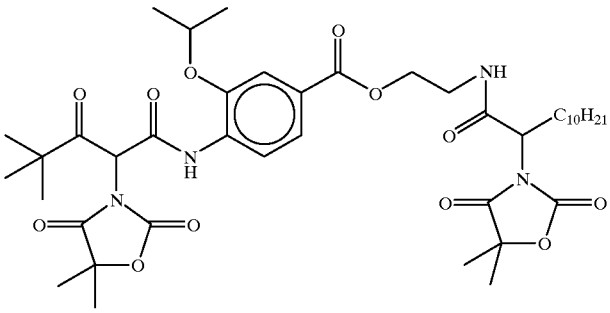
Y-19
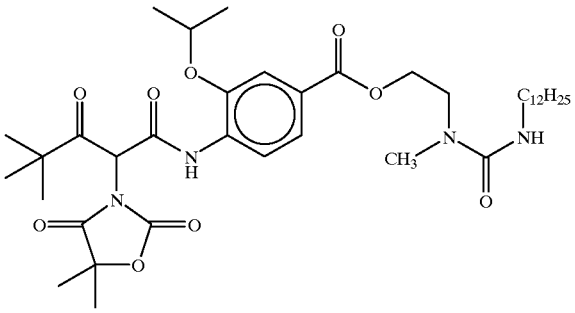

-continued
Y-20
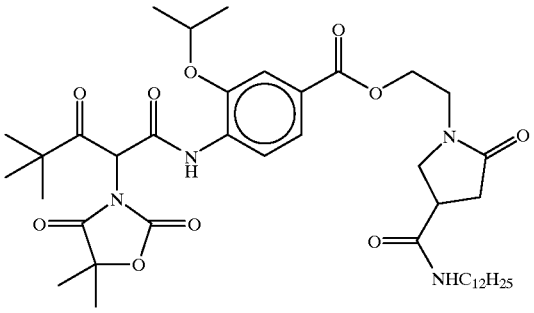
Y-21
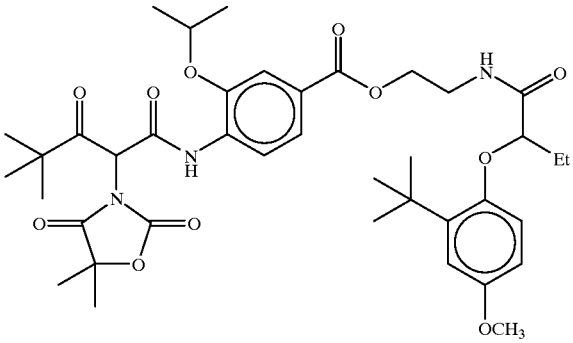
Y-22
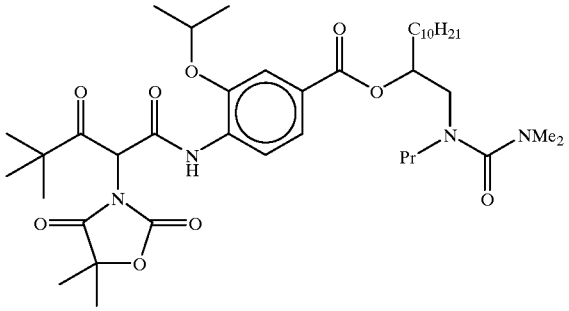
Y-23
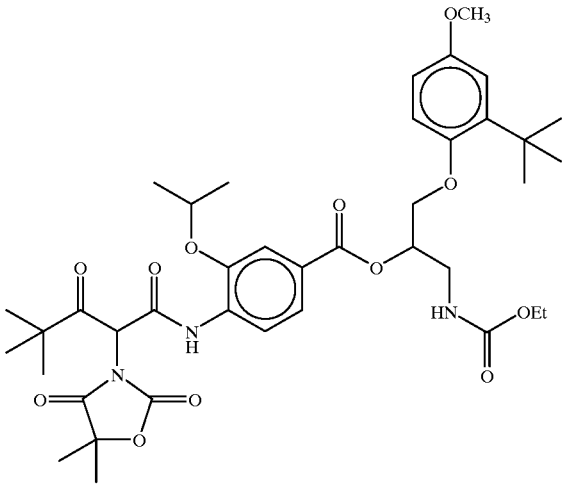

-continued
Y-24
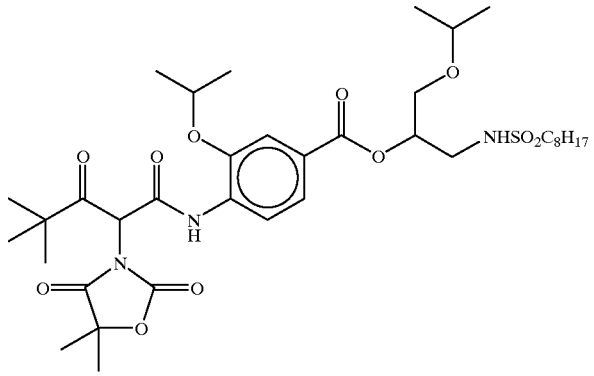
Y-25
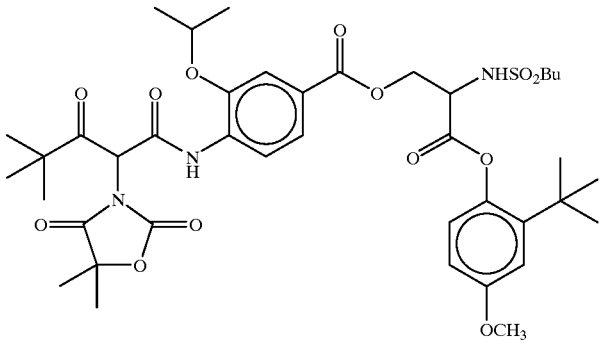
Y-26
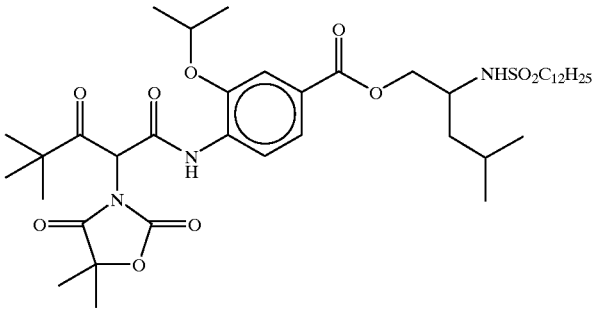
Y-27
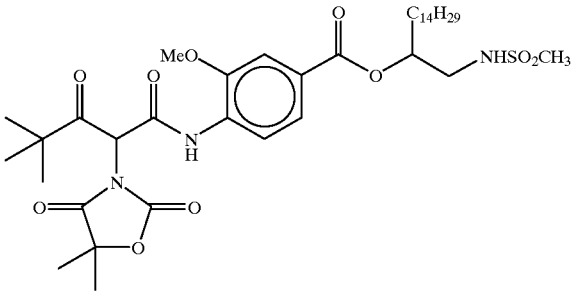

-continued
Y-28
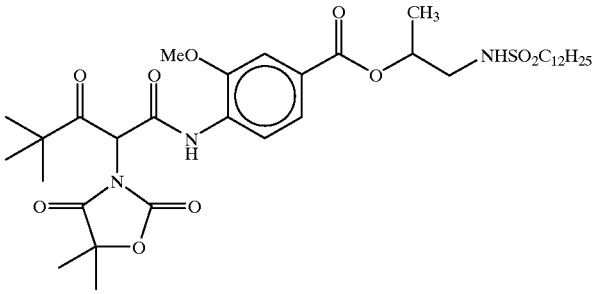
Y-29
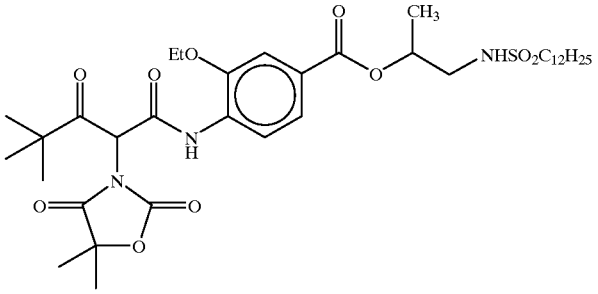
Y-30
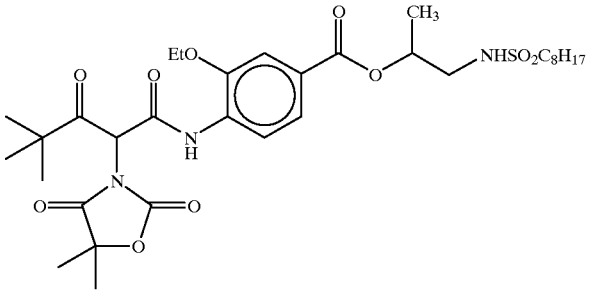
Y-31
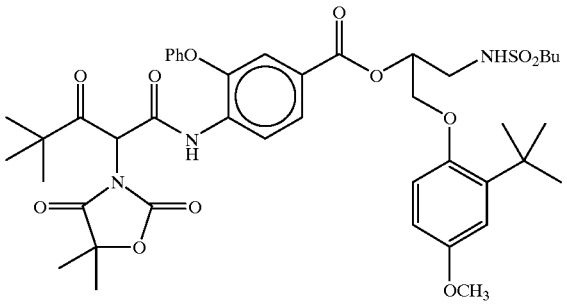
Y-32
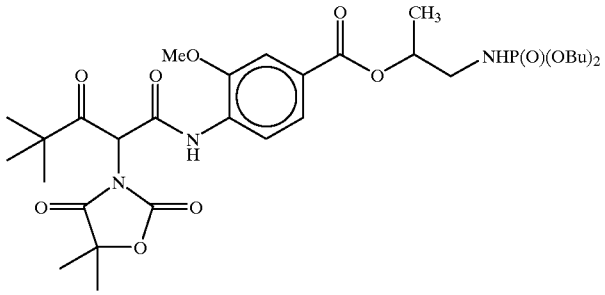

-continued
Y-33
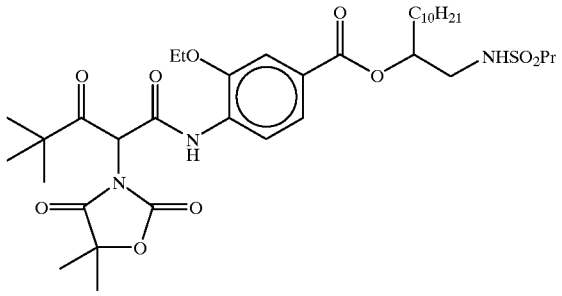
Y-34
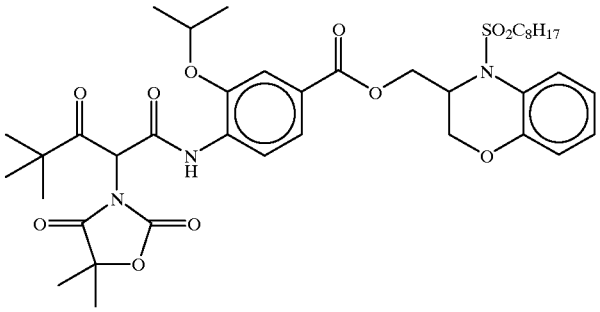
Y-35
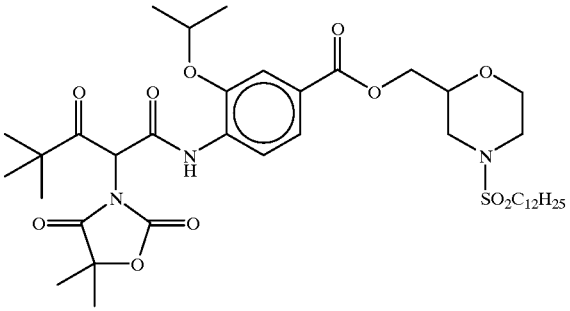
Y-36
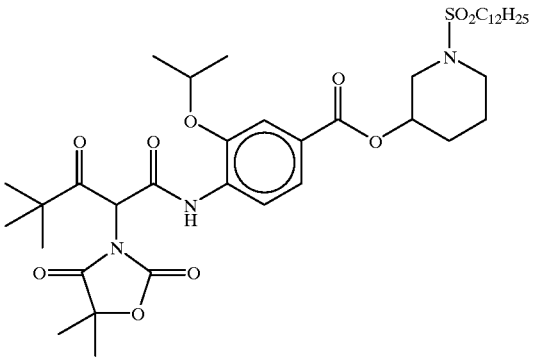

-continued
Y-37
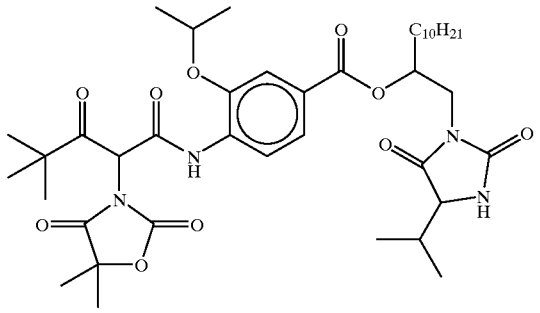
Y-38
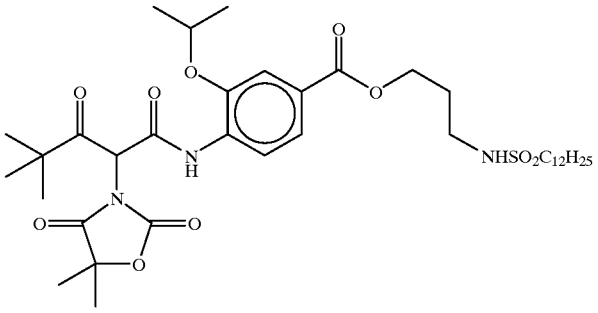
Y-39
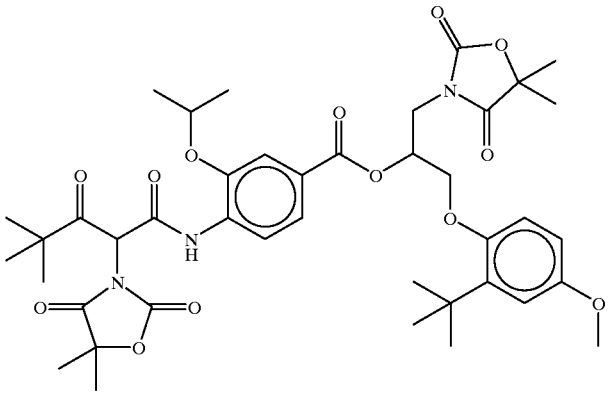
Y-40
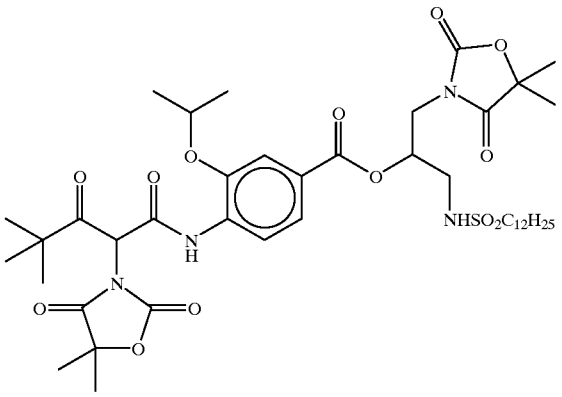

-continued
Y-41
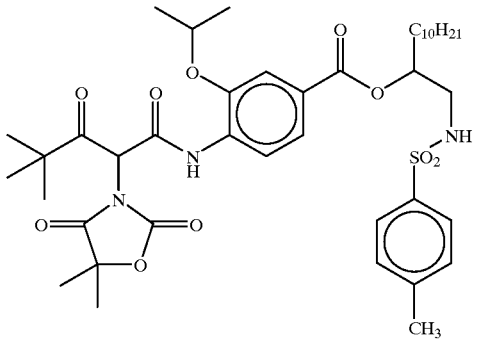
Y-42
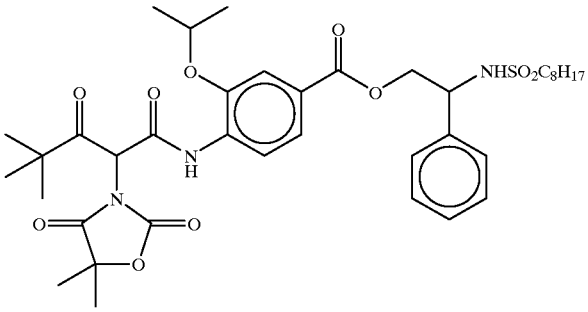
Y-43
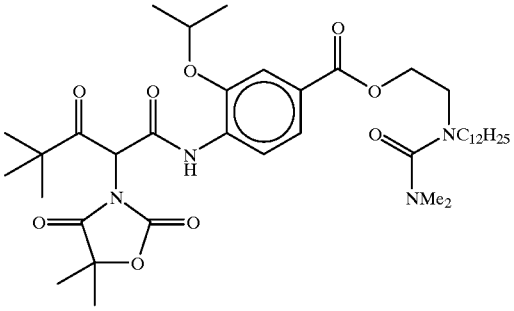
Y-44
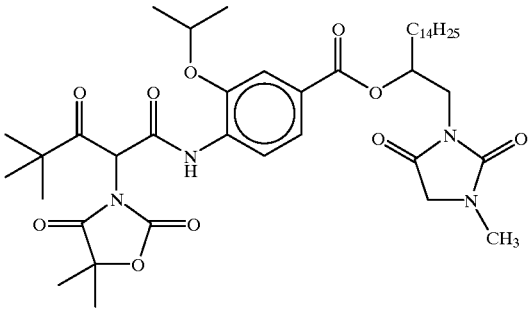

-continued
Y-45
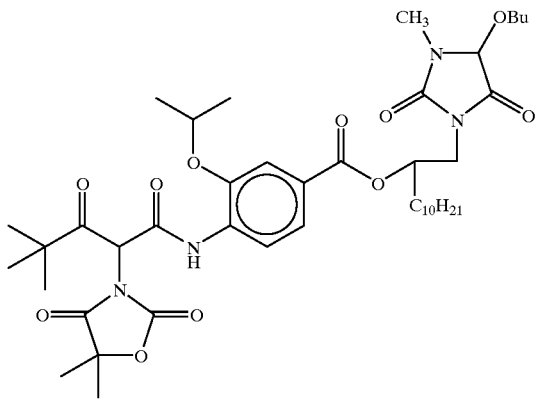
Y-46
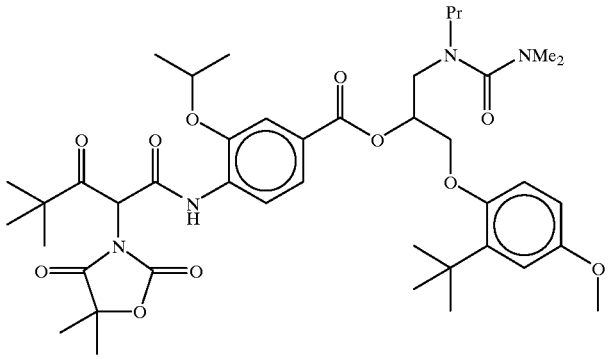
Y-47
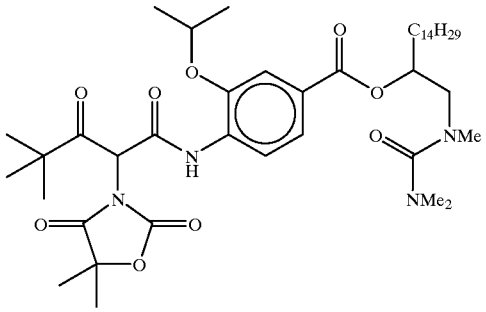
Y-48
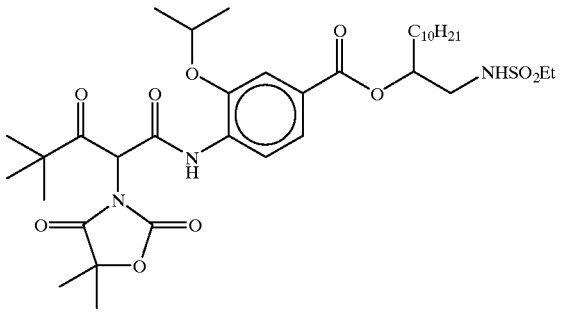

-continued

Y-49

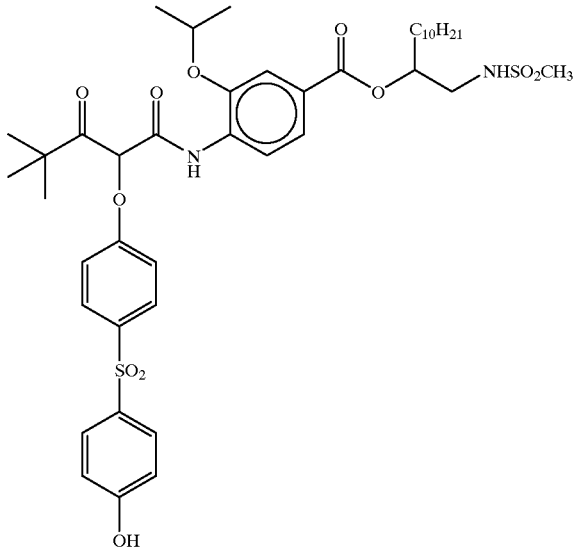

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, andN-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, andp-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, andp-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, and releasing or releasable groups. When a molecule may have two or more substituents, the substituents may be joined together to form a ring such as a fuised ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials useful in the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The Sections hereinafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305; 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126-156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 0 347,235; EPO 0 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841; EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp.112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the materials useful in the invention may be blocked or coated in protected form as described, for example, in Japanese Application 61/258,249 or U.S. Pat. No. 5,019, 492.

The invention may further be used in combination with image-modifying compounds that release PUGS such as "Developer Inhibitor-Releasing" compounds (DIR's). DIR's useful in conjunction with the invention are known in the art and examples are described in U.S. Pat. Nos. 3,137, 578; 3,148,022; 3,148,062; 3,227,554; 3,384,657; 3,379, 529; 3,615,506; 3,617,291; 3,620,746; 3,701,783; 3,733, 201; 4,049,455; 4,095,984; 4,126,459; 4,149,886; 4,150, 228; 4,211,562; 4,248,962; 4,259,437; 4,362,878; 4,409, 323; 4,477,563; 4,782,012; 4,962,018; 4,500,634; 4,579, 816; 4,607,004; 4,618,571; 4,678,739; 4,746,600; 4,746, 601; 4,791,049; 4,857,447; 4,865,959; 4,880,342; 4,886, 736; 4,937,179; 4,946,767; 4,948,716; 4,952,485; 4,956, 269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378, 236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

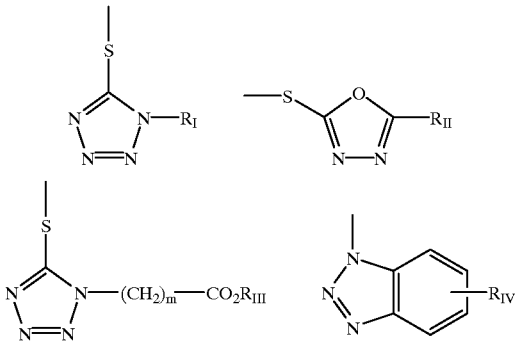

-continued

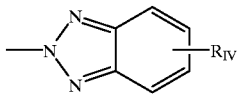

wherein $R_I$ is selected from the group consisting of straight and branched alkyls of from 1 about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

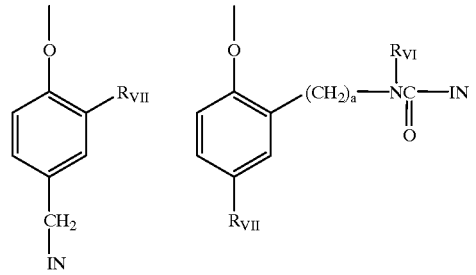

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$, is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:
D1
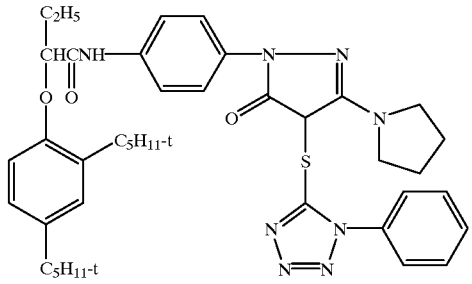
D2
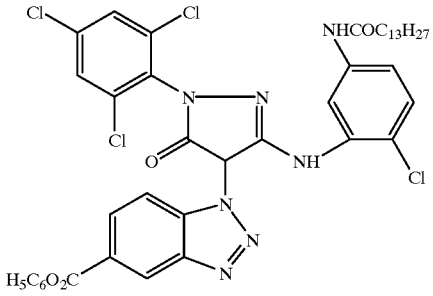
D3
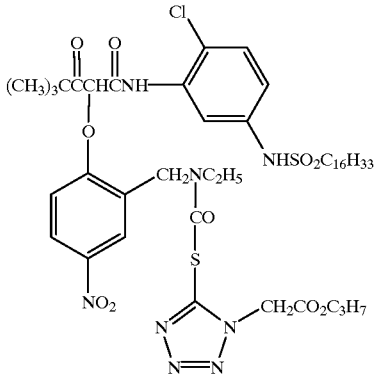
D4
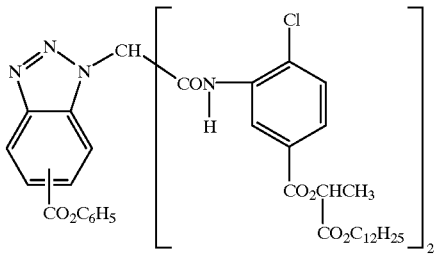
D5
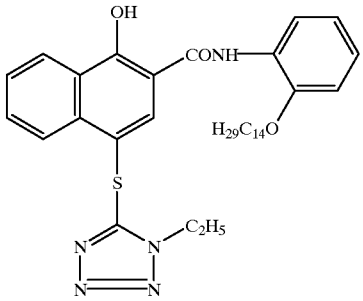
-continued
D6
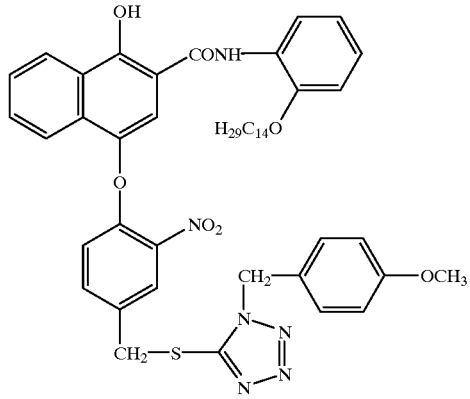
D7
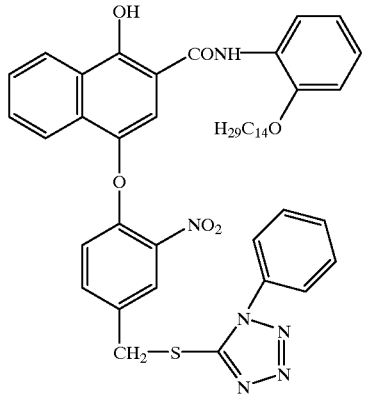
D8
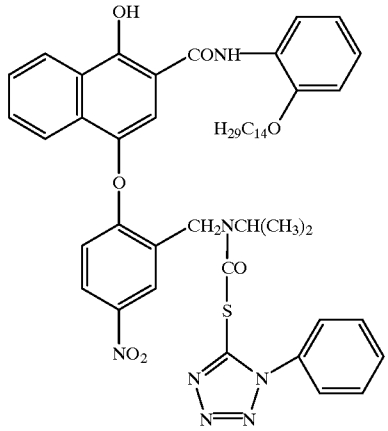
D9
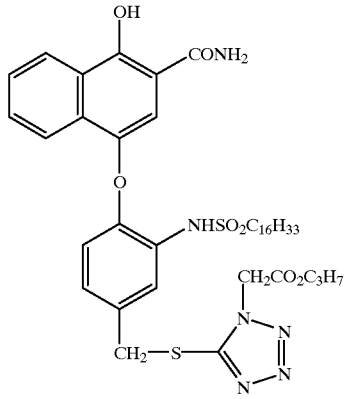

-continued

D10

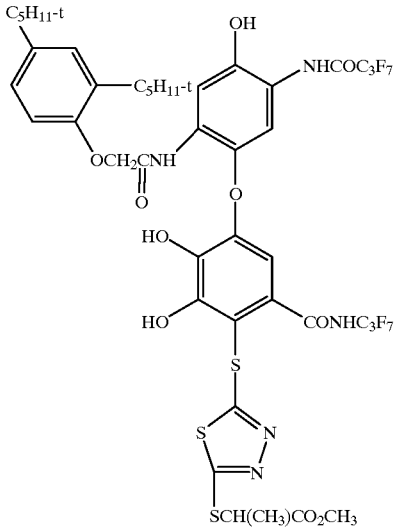

D11

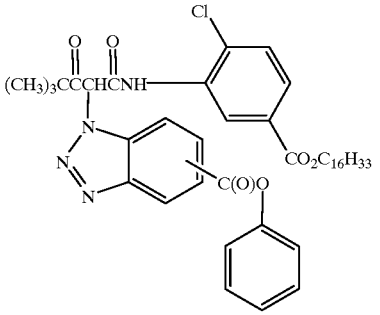

D12

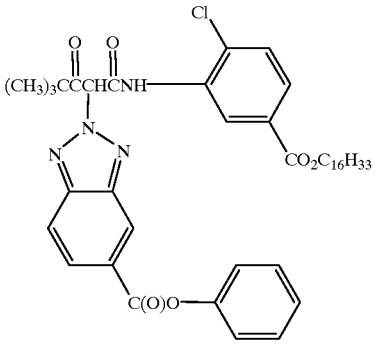

It is also contemplated that the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England. Materials useful in the invention may be coated on pH adjusted support as described in U.S. Pat. No. 4,917,994; on a support with reduced oxygen permeability (EP 553, 339), with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,17 5 and 5,614,3 59, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyarnada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIIIB(5) may be used.

A "color negative element" utilizes negative-working silver halide and provides a negative image upon processing. A first type of such element is a capture element, which is a color negative film that is designed for capturing an image in negative form rather than for viewing an image. A second type of such an element is a direct-view element that is designed, at least in part, for providing a positive image viewable by humans.

In the capture element, speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

A direct-view photographic element is one which yields a color image that is designed for human viewing (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by digitally printing or by optically printing an image from a color negative onto the direct-viewing element and processing though an appropriate negative-working photographic process to give a positive color image. The element may be sold packaged with instructions for digital printing or for processing using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less. Color slides may be produced in a similar manner but are more typically produced by exposing the film directly in a camera and processing through a reversal color process or a direct positive process to give a positive color image. The foregoing images may also be produced by alternative processes such as digital printing.

Each of these types of photographic elements has its own particular requirements for dye hue, but in general they all require cyan dyes whose absorption bands are less deeply absorbing (that is, shifted away from the red end of the spectrum) than color negative films. This is because dyes in direct-view elements are selected to have the best appearance when viewed by human eyes, whereas the dyes in image capture materials are designed to best match the needs of the printing process.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

The photographic element of the invention can be incorporated into exposure structures intended for repeated use or exposure structures intended for limited use, variously referred to by names such as "single use cameras", "lens with film", or "photosensitive material package units".

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

Synthesis

The couplers of the invention are readily prepared through conventional techniques. The following will demonstrate a suitable method.

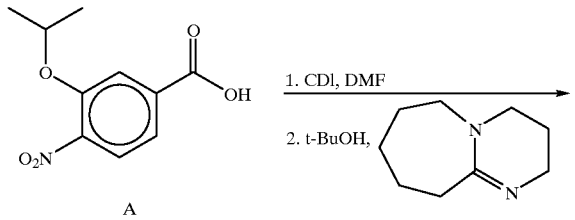

A

-continued

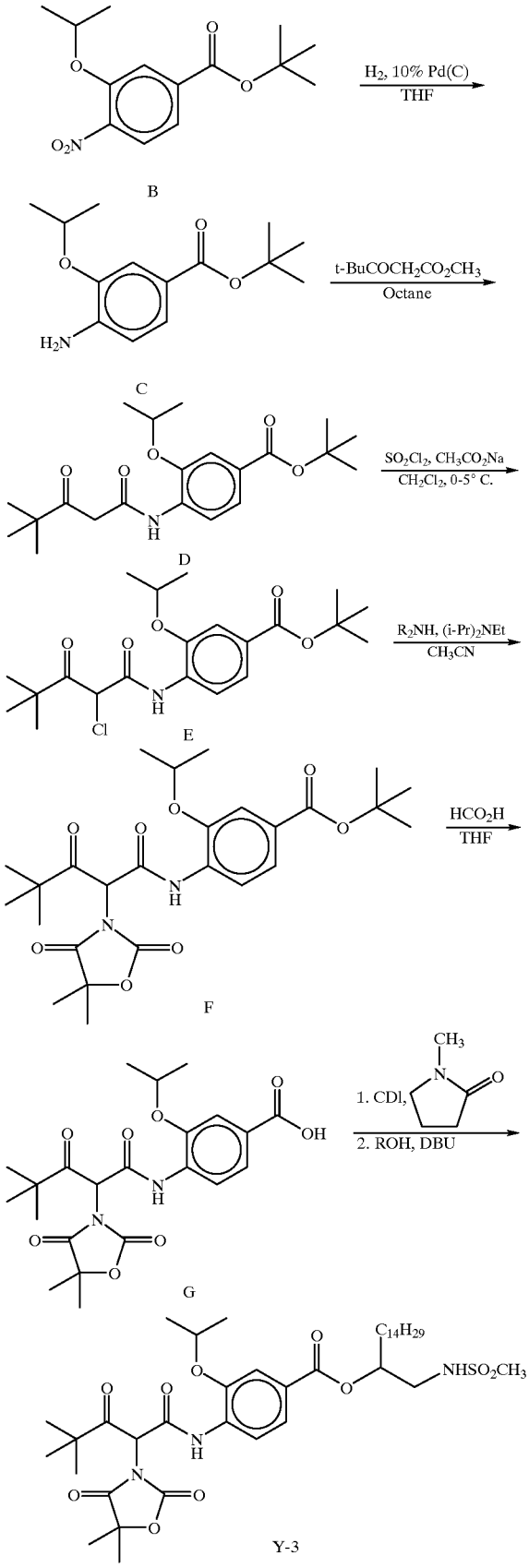

Preparation of t-butyl 3-isopropoxy-4-nitrobenzoate (Compound B).

1,1'-Carbonyldiimidazole (72.0 g, 0.444 mol) was added to 200 mL dry dimethylformamide (DMF) in a 1 L three-neck round bottom flask under a nitrogen atmosphere. Solid3-isopropoxy-4-nitrobenzoic acid(CompoundA)(100 g, 0.444 mol) was added in portions to the stirred solution at a rate to control carbon dioxide evolution. A thick precipitate formed after 15 min. After one hour dry t-butyl alcohol (65.8 g, 0.888 mol) and then 1,8-diazabicyclo[5.4.0]undec-7-ene (DBU)(67.5 g, 0.444 mol) were added to get a light yellow-brown solution accompanied by a slight temperature rise. After standing for three hours the solution was partitioned between 500 mL ether and a 1 L ice-water mixture containing 120 mL HCl. The aqueous layer was extracted with 500 ML ether, and the combined ether layers washed with 3×150 mL water and 100ML brine. The light orange-colored ether solution was dried over $MgSO_4$, filtered, and evaporated to an oil. Heptane (50 mL) was added, and the solution evaporated to obtain a solid. The crude product was chromatographed through 500 g silica gel in a 1 L sintered glass filter funnel using dichloromethane. On evaporation, the resulting solid was slurried in cold heptane and filtered to give 106.6 g light yellow solid. Concentration of the filtrate gave an additional 5.0 g compound B (total yield: 111.6 g, 89.4%).

Preparation of t-butyl 4-amino-3-isopropoxybenzoate (Compound C).

Compound B (110.0 g, 0.391 mol) was divided into two equal portions, and each dissolved in 150 mL THF in a 500 mL glass Parr bottle along with 2.0 g 10% Pd on carbon (50% wet). Each was hydrogenated at an initial pressure of 3.65 $kg/m^2$ (50psi) hydrogen. After 20 minutes shaking was stopped for 30 min to let the solution cool back to room temperature. The hydrogen pressure was 1.4 $kg/m^2$, (9.1 kg (20 lb) hydrogen taken up, of 42.7 kg (94 lb) required). This procedure was repeated twice more, and then the hydrogenation was continued uninterrupted for two hours. The catalyst was filtered off, and the combined filtrates were evaporated to give compound C (98.8 g colorless solid, 100%). The solid was used without further purification.

Preparation of t-butyl 3-isopropoxy-4-(4,4-dimethyl-3-oxovaleramido)-benzoate (Compound D).

Compound C (140 g, 0.558 mol) and methyl 4,4-dimethyl-3-oxovalerate (88.3 g, 0.572 mol) were dissolved in 150 mL octane in a 500 mL round bottom flask fitted with a Dean-Stark trap and reflux condenser fitted with a gas-dispersion tube. The trap was wrapped with a towel and periodically soaked with acetone. This provided evaporative cooling aid in the separation of methanol from octane. The stirred solution was gently refluxed and the liberated methanol collected in the trap. Thin layer chromatography (TLC) (silica gel, 3:7 heptane: dichloromethane) showed the reaction was about 60% complete within 30 min. After five hours TLC showed only a trace of compound C. The light orange-red solution was cooled somewhat and diluted with 200 mL dichloromethane. The solution was chromatographed through 1 L silica gel in a 1.0 L sintered glass filter funnel using 3:7 heptane:dichloromethane. The product-containing fractions were combined and evaporated to a solid. The solid was slurried in 500 mL cold heptane for 20 min and filtered. The solid was washed with 2×50 mL cold heptane to remove an orange-red color. Drying gave compound D (172 g very pale yellow solid). The filtrate was evaporated to an orange-red oil (39.3 g). The oil was dissolved in 100 mL heptane and seeded. After cooling in an ice bath for 20 min filtration gave a further 13.5 g compound D. Likewise, a third crop of 8.5 g was obtained. Total yield compound D: 194 g, 92%.

Preparation of t-butyl 3-isopropoxy-4-(2-chloro-4,4-dimethyl-3-oxovaleramido)-benzoate (Compound E).

Compound D (130 g, 0.344 mol) and anhydrous sodium acetate (42.4 g, 0.516 mol) were combined in 300 miL dichloromethane in a 1 L three-neck flask fitted with a thermometer, addition funnel, and a gas inlet/outlet tube connected to a water aspirator acting as a gas scrubber. The stirred slurry was cooled to −5° C. in an ice/acetone bath under nitrogen. Thionyl chloride (46.5 g, 0.344 mol) was added dropwise to the stirred slurry, keeping the temperature below 5° C. TLC (50:45:5 heptane: dichloromethane:ethyl acetate) at the end of the addition showed some starting material. An additional 4 g thionyl chloride was added in 1 g portions, analyzing for residual Compound D after each addition. The final TLC showed only product and a trace of the dichlorinated product. The reaction mixture was slowly partitioned between 500 mL ethyl acetate and 1 L water containing 40 g sodium acetate. The aqueous layer was extracted with 200 ethyl acetate. The ethyl acetate layers were combined with 200 mL more ethyl acetate, and the solution extracted with 2×300 mL brine. The solution was dried over $MgSO_4$, filtered, and evaporated to an orange-brown oil. Heptane (250 mL) was added and the solution evaporated to remove some residual acetic acid. The oil was chromatographed through 0.9 L silica gel in a 1 L sintered glass filter funnel. Heptane: dichloromethane (2:8) was used to remove most of the product, and then dichloromethane to remove the rest. The combined product fractions were evaporated to an orange oil. The oil was dissolved in 250 mL heptane, seeded, and left at room temperature overnight. The mixture was then cooled for 30 min in an ice bath and filtered to give 125 g colorless solid. The filtrate was evaporated and the residue crystallized from 35 mL cold heptane to give an additional 6.0 g off-white solid, pure by TLC. Total yield compound E: 131 g, 92%.

Preparation of t-butyl 3-isopropoxy-4-[4,4-dimethyl-2-(5,5-dimethyloxazolidinedione)-3-oxovaleramido]-benzoate (Compound F).

Compound E (125 g, 0.303 mol) and 5,5-dimethyl-2,4-oxazolidinedione (40.2 g, 0.311 mol) were added to 400 mL dry acetonitrile in a 1 L flask. N,N-diisopropylethyl amine (82.3 g, 0.637 mol) was added to the slurry, and the resulting solution refluxed. After 1.25 hours TLC (40:55:5 heptane:dichloromethane:ethyl acetate) showed the reaction was complete. The solution was poured into a 1.25 L ice-water mixture containing 50 mL HCl. The aqueous layer was decanted from the oily product and extracted with 300 mL ethyl acetate. The oily product was diluted with 200 mL ethyl acetate, and the combined ethyl acetate solutions were washed with 2×250 mL water and 100 mL brine. The solution was dried over $MgSO_4$, filtered, and evaporated to obtain a solid. The solid was slurried in 200 mL heptane and the mixture cooled in an ice bath for 30 min. It was then filtered, and the solid washed with 2:1 heptane: ethyl acetate to obtain 134.2 g colorless solid. The filtrate was evaporated and the residue crystallized from hetane: ethyl acetate gave an additional 13.8 g colorless solid. Total yield compound F: 148 g, 97%.

Preparation of 3-isopropoxy-4-[4,4-dimethyl-2-(5,5-dimethyloxazolidinedione)-3-oxovaleramido]-benzoic acid (Compound G).

Compound F (146 g, 0.289 mol) was added to a solution of 500 g formic acid and 100 mL THF in a 1 L Erlenmeyer flask. The stirred slurry was heated in a hot water bath to 65° C. to get a colorless solution. After 1 hour the solution was cooled and evaporated to a colorless solid. Isopropyl ether (250 mL) was added, and the solid filtered. Evaporation of the filtrate gave a small second crop. Total yield compound G: 126 g, 97%.

Preparation of 1-methanesulfonamido-2-hexadecyl-3-isopropoxy-4-[4,4-dimethyl-2-(5,5-dimethyloxazolidinedione)-3-oxovaleramido]-benzoate (Example Yellow Coupler Y-3).

(a.) 1,2-Epoxyhexadecane (technical grade, 85%) (10.0 g, 36.4 mmol) and methanesulfonamide (5.1 g, 53 mmol) were combined with 7 mL 1-methy-2-pyrrolidinone in a 50 mL Erlenmeyer flask. One KOH pellet (0.15 g) and 18-crown-6 (0.15 g) were added. The stirred mixture was heated on a hot plate to 130° C. to get a solution. After 1.5 hours the solution was partitioned between 100 mL 3:1 ethyl acetate:heptane and 100 mL water containing 5 mL HCl. The organic phase was washed with 3×25 mL water and then 50 mL brine. The product crystallized from the solution. It was filtered and washed with 3×25 mL water and 2×25 mL heptane to obtain 9.5 g off-white solid. The product was recrystallized from 40 mL acetonitrile to give 9.0 g (80%) 1-methanesulfonamido-2-hexadecanol. (b.) Compound G (3.00 g, 6.69 mmol) was dissolved in 15 mL anhydrous 1-methyl-2-pyrrolidinone with warming in a 100 mL flask fitted with a gas dispersion tube. The solution was cooled to room temperature and 1,1'-carbonyldiimidazole (1.19 g, 7.36 mmol) was added. After 30 min 1-methanesulfonamido-2-hexadecanol (2.24 g, 7.36 mmol) and DBU (2.24 g, 14.7 mmol) were added to the pale yellow solution. The solution was left standing overnight. The solution was partitioned between 100 mL ethyl acetate and 100 mL water containing 5 mL HCl. Heptane (10 mL) was added to the ethyl acetate layer, and then it was washed with 4×50 mL water, followed by 50 mL brine. The solution was dried over $MgSO_4$, filtered, and evaporated to give a pale yellow glass. The glass was chromatographed through 0.6 L silica gel in a 1 L sintered glass filter funnel using 7.5% ethyl acetate in dichloromethane. Fractions containing pure product were combined and evaporated to give a colorless glass.

The glass crystallized from isopropyl ether to give 4.18 g (81.5%) Compound Y-3, a colorless solid, mp 92–94° C.

EXAMPLE 1

Dispersion Preparation

The dispersion for Example 1 was prepared by combining a solution containing 2.00 g of coupler with 0. 19 g stabilizer STI, 0.06 g stabilizer ST2, 0.25 g stabilizer ST3, and 1.00 g of tri-butyl citrate at 130° C. with an 80° C. solution containing 2.75 g of decalcified gelatin, 2.75 g of a 10% solution of surfactant Alkanol XC (trademark of E.I. Dupont Co.), and 64.00 g of demineralized water. This combined solution was mixed for one minute at 8000 rpm using a Brinkmann rotor-stator mixer, then homogenized via 2 passes through a Microfluidics Microfluidizer at 3.65 $kg/cm^2$ (8000 psi), 80° C. to produce dispersion 1. This dispersion was then placed in cold storage until ready for combination with a light-sensitive photographic emulsion in a photographic element.

The dispersions for all the other example were prepared in the same way, except that the stabilizer levels for ST1, ST2 and ST3 were adjusted to allow a constant stabilizer laydown to be achieved when coating couplers of different molecular weight at equimolar laydown.

The formulae of the stabilizers were as follows:

ST1

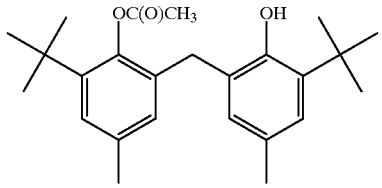

ST2

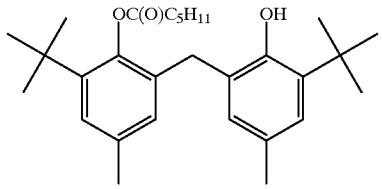

ST3

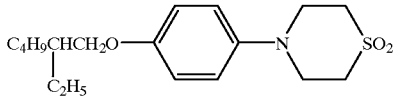

Coating Evaluation

Photographic elements were prepared by using dispersions prepared by the above method coated in the following format on gel-subbed, polyethylene-coated paper support.

First Layer

An underlayer containing 3.23 g gelatin per square meter

Second Layer

A photosensitive layer containing (per square meter) 2.15 g of gelatin, an amount of blue-sensitized silver chloride emulsion containing the silver necessary to coat 0.215 g of silver, and an amount of dispersion necessary to coat 0.638mmoles of coupler.

Third Layer

A layer containing 1.40 g gelatin (per square meter), 0.509 g of UV absorber UV1, and 0.090 g of UV absorber UV2.

Fourth Layer

A protective layer containing (per square meter) 1.08 g gelatin, 0.176 g bis(vinylsulfonyl)methane ether, 45.3 mg Alkanol XC, and 4.41 mg tetraethylammonium perfluorooctanesulfonate.

The UV stabilizers were as follows:

UV-1

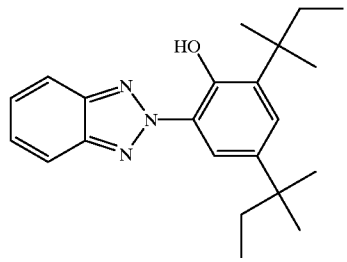

UV-2

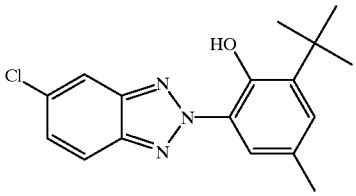

Preparation of Processed Photographic Examples

Processed samples were prepared by exposing the coatings through a step wedge and processing in standard RA-4 development chemistry, described in the British Journal of Photography Annual of 1998, pp 198–199.

The Status A yellow densities of the processed strips were read and sensitometric curves (density vs. log exposure) were generated. The Shoulder density value was calculated by determining the density at 0.4 log E higher exposure than the log E value corresponding to a density of 0.8. Maximum density was recorded as D-max. The light stability of the formed yellow image dyes was measured for each strip after four weeks of high intensity daylight (HID) exposure (Xenon arc lamp at an intensity of 50 Klux). The thermal (dark) stability of each strip was measured after 4 weeks of treatment at 85° C./50% RH. For both tests the amount of density loss from 1.0 was measured and is shown in Table I.

The comparative couplers were as follows:

YC-1

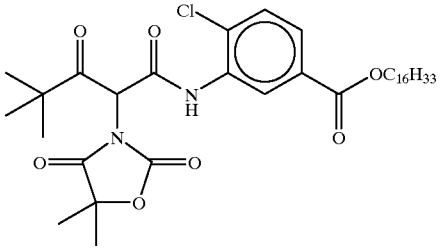

-continued
YC-2
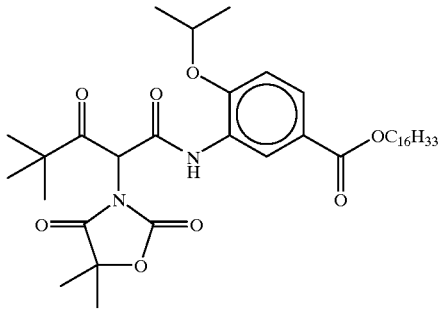
YC-3
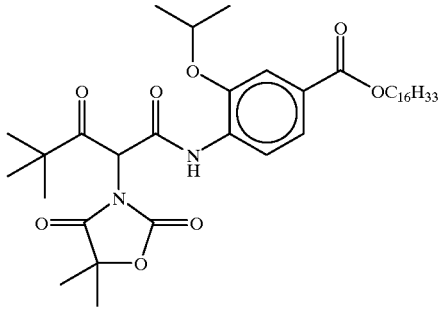
YC-4
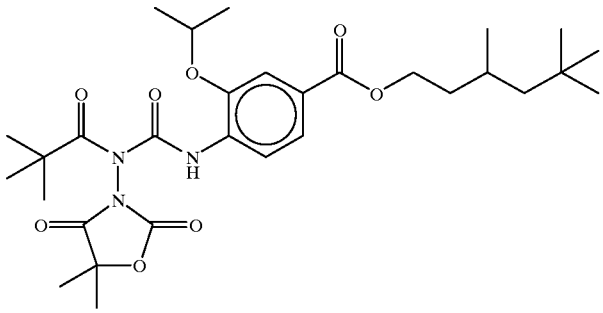
YC-5
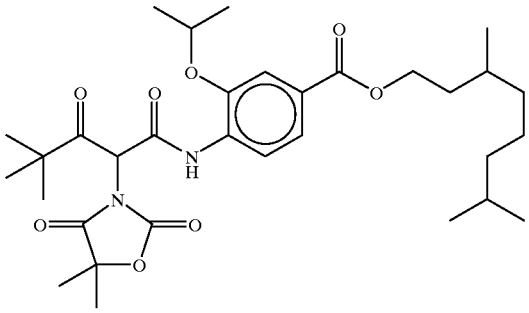

-continued

YC-6

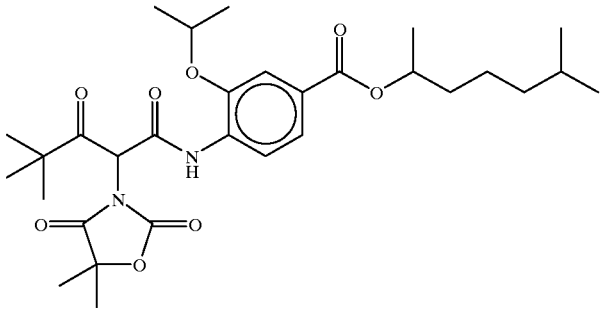

YC-7

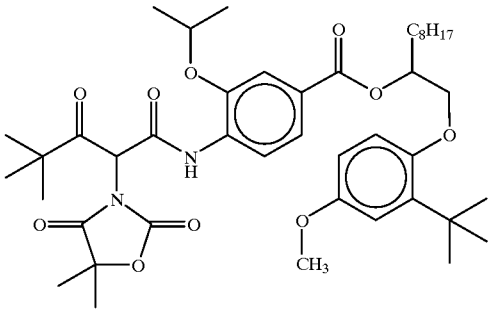

YC-8

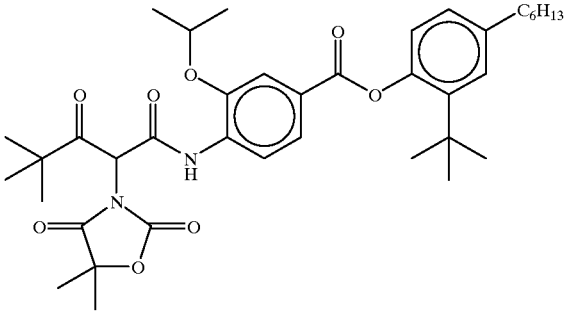

The photographic data is presented in Table I below. The couplers useful in this invention generally show either improved reactivity, or improved light stability, or both, while maintaining good dark fade (thermal stability). Y-1 provides acceptable fade resistance but the activity is not as good as other samples and this is believed due to a lower than planned laydown and due to the presence of the phenoxy group in A in combination with an alkyl group of four carbon atoms.

TABLE I

Photographic Results

| Sample | Coupler | Type | 0.4 Shoulder | Dmax | Light Fade* | Dark Fade** |
|---|---|---|---|---|---|---|
| 1 | YC-1 | Comp | 1.91 | 2.16 | −0.59 | −0.10 |
| 2 | YC-2 | Comp | 1.76 | 1.96 | −0.29 | −0.04 |
| 3 | YC-3 | Comp | 1.92 | 2.15 | −0.38 | −0.03 |
| 4 | YC-4 | Comp | 1.83 | 2.03 | −0.28 | −0.04 |
| 5 | YC-5 | Comp | 1.86 | 2.09 | −0.30 | −0.02 |
| 6 | YC-6 | Comp | 1.80 | 2.01 | −0.31 | −0.06 |
| 7 | YC-7 | Comp | 1.76 | 1.99 | −0.16 | −0.02 |
| 8 | YC-8 | Comp | 1.76 | 1.96 | −0.15 | −0.01 |

TABLE I-continued

Photographic Results

| Sample | Coupler | Type | 0.4 Shoulder | Dmax | Light Fade* | Dark Fade** |
|---|---|---|---|---|---|---|
| 9 | Y-1 | Inv | 1.75 | 1.78 | −0.28 | −0.02 |
| 10 | Y-2 | Inv | 1.98 | 2.19 | −031 | −0.02 |
| 11 | Y-3 | Inv | 1.96 | 2.18 | −0.35 | −0.02 |
| 12 | Y-4 | Inv | 1.91 | 2.10 | −0.27 | −0.01 |
| 13 | Y-5 | Inv | 1.96 | 2.12 | −0.21 | −0.03 |
| 14 | Y-6 | Inv | 1.88 | 1.97 | −0.19 | −0.01 |
| 15 | Y-7 | Inv | 1.82 | 1.99 | −0.21 | −0.02 |
| 16 | Y-8 | Inv | 1.82 | 1.96 | −0.17 | −0.01 |
| 17 | Y-9 | Inv | 1.92 | 2.09 | −0.25 | −0.03 |
| 18 | Y-11 | Inv | 1.96 | 2.14 | −0.26 | −0.04 |
| 19 | Y-12 | Inv | 1.85 | 2.03 | −0.29 | −0.02 |

*4 Week HID @ 1.0
**4 Week @ 85° C./50% RH

All couplers coated equimolar, and with standard stabilizing package.

EXAMPLE 2

Samples were prepared and tested as above. Comparison couplers were as follows:

YC-9

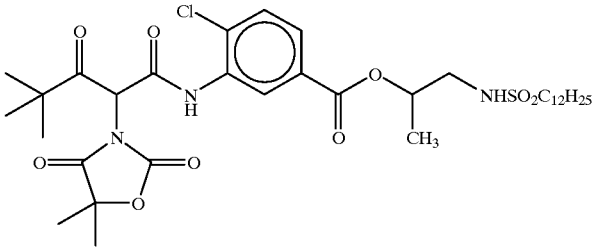

YC-10

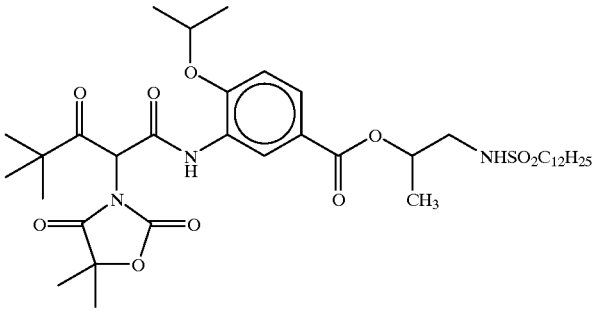

YC-11

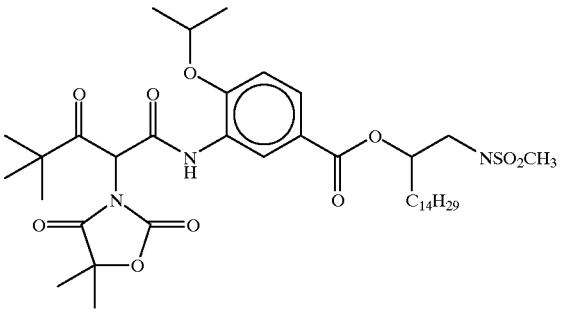

The results were as follows:

TABLE II

Photographic Results

| Sample | Coupler | Type | Detail | 0.4 Shoulder | Dmax | Light Fade* | Dark Fade** |
|---|---|---|---|---|---|---|---|
| 20 | YC-9 | Comp | o-Cl/ m-Ballast | 1.64 | 1.72 | −0.59 | −0.08 |
| 21 | YC-10 | Comp | o-alkoxy/ m-Ballast | 1.72 | 1.80 | −0.25 | −0.05 |
| 22 | Y-11 | Inv | o-alkoxy/ p-Ballast | 1.96 | 2.14 | −0.26 | −0.04 |
| 23 | YC-11 | Comp | o-alkoxy/ m-Ballast | 1.77 | 1.99 | −0.29 | −0.06 |
| 24 | Y-3 | Inv | o-alkoxy/ p-Ballast | 1.96 | 2.18 | −0.35 | −0.02 |

*4 Week HID @ 1.0
**4 Week @ 85° C./50% RH

Table II shows that the activity of the coupler useful in the invention, as measured by maximum density and a 0.4 shoulder, is far greater than that of the corresponding couplers absent either the para ballast or the ortho alkoxy group. Similarly, the stability of the formed dye under dark or light conditions is equal or improved.

The entire contents of the patents and other publications referred to in this specification and in the identified Research Disclosure publications are incorporated herein by reference.

What is claimed is:

1. A photographic element comprising a light sensitive silver halide emulsion layer having associated therewith a yellow dye-forming coupler having formula I:

I

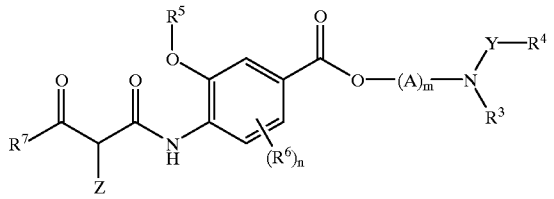

wherein each A is independently a divalent group selected from the divalent groups consisting of aryl and —C($R^1$)($R^2$)—, in which each $R^1$ and $R^2$ is independently selected from the group consisting of hydrogen, alkyl, alkoxy, aryloxy, heterocyclic, and aryl groups, and one A can be joined to form a ring with another A or with $R^3$, and m is from 2 to 6;

$R^3$ is selected from the group consisting of hydrogen, alkyl, heterocyclic, and aryl groups, provided that $R^3$ may form a ring with A or is a group joined to $R^4$ to form a heterocyclic five- or six-membered ring;

$R^4$ is selected from the group consisting of aryl, heterocyclic, and alkyl groups and may form a heterocyclic ring bonded to $R^3$;

$R^5$ is an aryl or alkyl group;

each $R^6$ is an independently selected substituent and n is 0 to 3, provided that two $R^6$ groups may join to from a ring;

$R^7$ is selected from a group consisting of alkyl, aryl, heterocyclic, alkoxy, and amino groups;

Y is selected from the group consisting of —$SO_2$—, —C(=O)—, —C(=O)$NR^9R^{10}$—, —C(=O)O—, and —P(=O)($OR^9$)($OR^{10}$—) where $R^9$ and $R^{10}$ are independently H or an alkyl or amyl group, and Z i s hydrogen or a coupling-off group.

2. The element of claim 1 wherein A is —C($R^1$)($R^2$)— and m is 2–6.

3. The element of claim 2 wherein m is 2 to 4.

4. The element of claim 3 wherein m is 2.

5. The element of claim 1 wherein $R^5$ is C-1 to C-4 alkyl.

6. The element of claim 5 wherein $R^5$ is isopropyl.

7. The element of claim 1 wherein Y is —$SO_2$— or —C(=O)—.

8. The element of claim 1 herein $R^3$ is H.

9. The element of claim 1 wherein $R^3$ and $R^4$ join to form a ring.

10. The element of claim 1 wherein each $R^1$ and $R^2$ group is free of phenoxy groups.

11. The element of claim 1 wherein an $R^1$ or $R^2$ group contains a phenoxy group and $R^4$ is a C1–C3 alkyl group.

12. The element of claim 1 wherein Z is a heterocyclic ring group bonded to the remainder of the coupler through a nitrogen atom in the ring.

13. The element of claim 1 wherein Z is an azole group.

14. The element of claim 13 wherein Z is selected from the group consisting of pyrazole, succinimide, hydantoin and oxazolidinedione groups.

15. The element of claim 14 wherein Z is an oxazolidinedione group.

16. The element of claim 15 wherein Z is a 5,5-dimethyloxazolidinedione group.

17. The element of claim 1 wherein A is —C($R^1$)($R^2$)— and $R^5$ is isopropyl.

18. The element of claim 17 wherein Y is —$SO_2$— or —C(=O)—.

19. The element of claim 18 wherein Z is an oxazolidinedione group.

20. The element of claim 1 wherein Z includes a group capable of releasing a photographically useful group.

21. The element of claim 1 wherein $R^6$ is selected from the group consisting of halogen, amino, and alkyl groups, and groups connected to the ring by oxygen or sulfur.

22. The element of claim 1 wherein $R^7$ is selected from the group consisting of phenyl, t-butyl, methylcyclopropyl, arylamino and nitrogen heterocyclic groups.

23. A method of forming an image in the element of claim 1 after imagewise exposure to light comprising contacting the element with a color developing agent.

* * * * *

UNITED STATES PATENT AND TRADEMARK OFFICE

CERTIFICATE OF CORRECTION

PATENT NO. : 6,329,130 B1 
DATED : December 11, 2001
INVENTOR(S) : Barbara B. Lussier, Michael J. Proseus, Paul A. Burns, Brian Thomas and Frank D. Coms It is certified that error appears in the above-identified patent and that said Letters Patent is hereby corrected as shown below:

Column 53,
Line 18, change "amyl" to -- aryl --.

Signed and Sealed this

Tenth Day of September, 2002

*Attest:*

*Attesting Officer*

JAMES E. ROGAN
*Director of the United States Patent and Trademark Office*